US006752138B2

(12) United States Patent
Taryoto

(10) Patent No.: US 6,752,138 B2
(45) Date of Patent: Jun. 22, 2004

(54) SHUTTLECOCK LAUNCHER AND METHOD FOR LAUNCHING

(76) Inventor: Jonathan Taryoto, 3A Hatton House, 15 Kotewall Road., Hong Kong (CN)

( * ) Notice: Subject to any disclaimer, the term of this patent is extended or adjusted under 35 U.S.C. 154(b) by 0 days.

(21) Appl. No.: 10/120,436

(22) Filed: Apr. 12, 2002

(65) Prior Publication Data

US 2003/0192522 A1 Oct. 16, 2003

(51) Int. Cl.[7] ..... F41B 4/00
(52) U.S. Cl. ..... 124/78
(58) Field of Search ..... 124/6, 78

(56) References Cited

U.S. PATENT DOCUMENTS 3,641,704 A * 2/1972 Sims et al.
4,193,591 A * 3/1980 Paulson
4,372,284 A * 2/1983 Shannon et al. ..... 124/78
4,834,060 A * 5/1989 Greene ..... 124/78
5,125,653 A * 6/1992 Kovacs et al.
5,947,101 A * 9/1999 Kerr ..... 124/78

* cited by examiner

*Primary Examiner*—John A. Ricci

(57) ABSTRACT

A shuttlecock-throwing machine is provided to permit delivery of successive shuttlecocks at different frequencies, trajectories and speeds. The machine includes a shuttlecock dispenser, a feeding mechanism and an ejecting unit. The ejecting unit consists of two motors-driven recoiling counter rotating wheels being fed successively by the feeding mechanism therein gripping the shuttlecock's cap or nose and propelled the shuttlecock in the path of wheels plane. The shuttlecock dispenser comprising a pair of parallel or spiral bar, spaced apart and set at an incline to queue shuttlecocks with the noses side down over the feeding mechanism. The feeding mechanism consists of a motor-driven four-spoke rotor which draw the shuttlecocks from its dispenser and deliver one by one into the ejecting device.

14 Claims, 4 Drawing Sheets

SHUTTLECOCK LAUNCHER AND METHOD FOR LAUNCHING

BACKGROUND OF THE INVENTION

The present invention relates to the automatic launching of badminton shuttlecocks at different frequencies, trajectories and speeds to a desired direction relative to a player. More particularly, this invention relates to the simplicity and reliability for launching shuttlecocks notwithstanding the varying quality and condition of the shuttle, for purposes of recreation, training aid or shuttlecock speed testing.

A wide variety of ball throwing machines employing counter rotating wheels have been used in the past for activities such as tennis, ping pong, baseball and volley ball practice. These machines propel spherical objects or the like such as disclosed in U.S. Pat. No. 6,082,350 and WO9411069. They are not suitable for propelling a non spherical object such as a shuttlecock. Although mention is made for the use in the game of badminton in these patents, an adaptation of the device for that purpose is neither shown nor a claim sought. Moreover, applying a pair of concave rotating wheels to propel a shuttlecock through a gap formed between two concave wheels is not viable due to the lack of surface contact available on a conical shape projectile such as a shuttlecock. Additionally, the mechanism for the delivery of the shuttlecock into the gap formed between the two concave wheels would require a high degree of mechanical complexity.

GB2355411 and WO9319822 disclose shuttlecock throwing apparatus which utilize compressed air to propel shuttlecocks. Such devices need some degree of mechanical complexity for loading and positioning the shuttlecock from the magazine into the shooting tube.

DE3644607, JP1227775, JP1236075, JP7163694 employ swing arms, spring loaded mechanisms or mechanical impact plates to propel the shuttlecock. These prior art machines suffer from the same limitations of operating rigidity, mechanical complexity, high manufacturing cost and relatively high operating cost.

JP9117539, FR2799133 and other prior art machines employ a hopper tube for having plural shuttles stacked on each other axially, a shuttle transfer mechanism comprising a pair of rotary bodies rotated to each other by a drive source for dropping the shuttle. At the outset these mechanisms are complicated and often fail as two or more shuttlecocks tend to stick to one another when stacked and consequently two or more shuttles will be propelled at one time. Another drawback in prior art devices is the inability to cope with lightly worn shuttles-feathers which may impede or prematurely fall into the ejecting mechanism resulting in a miss or accidental launching.

Likewise, a shuttlecock shooting machine manufactured by Sport & Teknik, Sweden, employs an external pneumatic supply and uses a hopper tube to contain stacked shuttles on top of each other. Therefore, there is a need for a device that is inexpensive to manufacture having simpler and improved means for automatically ejecting shuttlecocks in a wide range of trajectories for use in shuttlecock speed grading, recreation or as a training aid.

BRIEF SUMMARY OF THE INVENTION

The basic concept of this invention employs a pair of articulated counter rotating wheels for gripping and propelling the shuttlecock nose or cap member, a shuttlecock dispenser which positions shuttlecocks led in queue and a loading mechanism which simply pushes the queue shuttlecock into the gap of the rotating wheels thereby causing contact between the shuttlecock cap and the ejecting wheels. This invention provides a highly versatile shuttlecock launcher avoiding the foregoing and other shortcomings and disadvantages of prior constructions. Accordingly, it is also the objective of the present invention to provide a launcher that is capable of simulating most of the shuttlecock trajectories experienced in the actual playing of badminton. To achieve the foregoing and other objects and in accordance with the purpose of the present invention, a shuttlecock-throwing machine is provided to permit delivery of successive shuttlecocks at different frequency, trajectory and speed in a desired direction of a player's court and which is of relatively simplified construction for economical manufacture and minimum cost of maintenance and repair.

The foregoing and other objects and advantages of this invention will appear in the cited claims and the following description, taken in connection with the accompanying drawings of a preferred embodiment.

DETAILED DESCRIPTION OF THE INVENTION

The following is a description and discussion with reference to the drawings. It should be noted that such discussion and description is not meant to unduly limit the scope of the invention.

The game of badminton does not require spin or curve balls in flight or after bouncing as in tennis or ping pong. In badminton, the shuttlecock is played while still in flight. Therefore, a relatively simple and inexpensive implementation of the invention is herein described.

Figure 1:
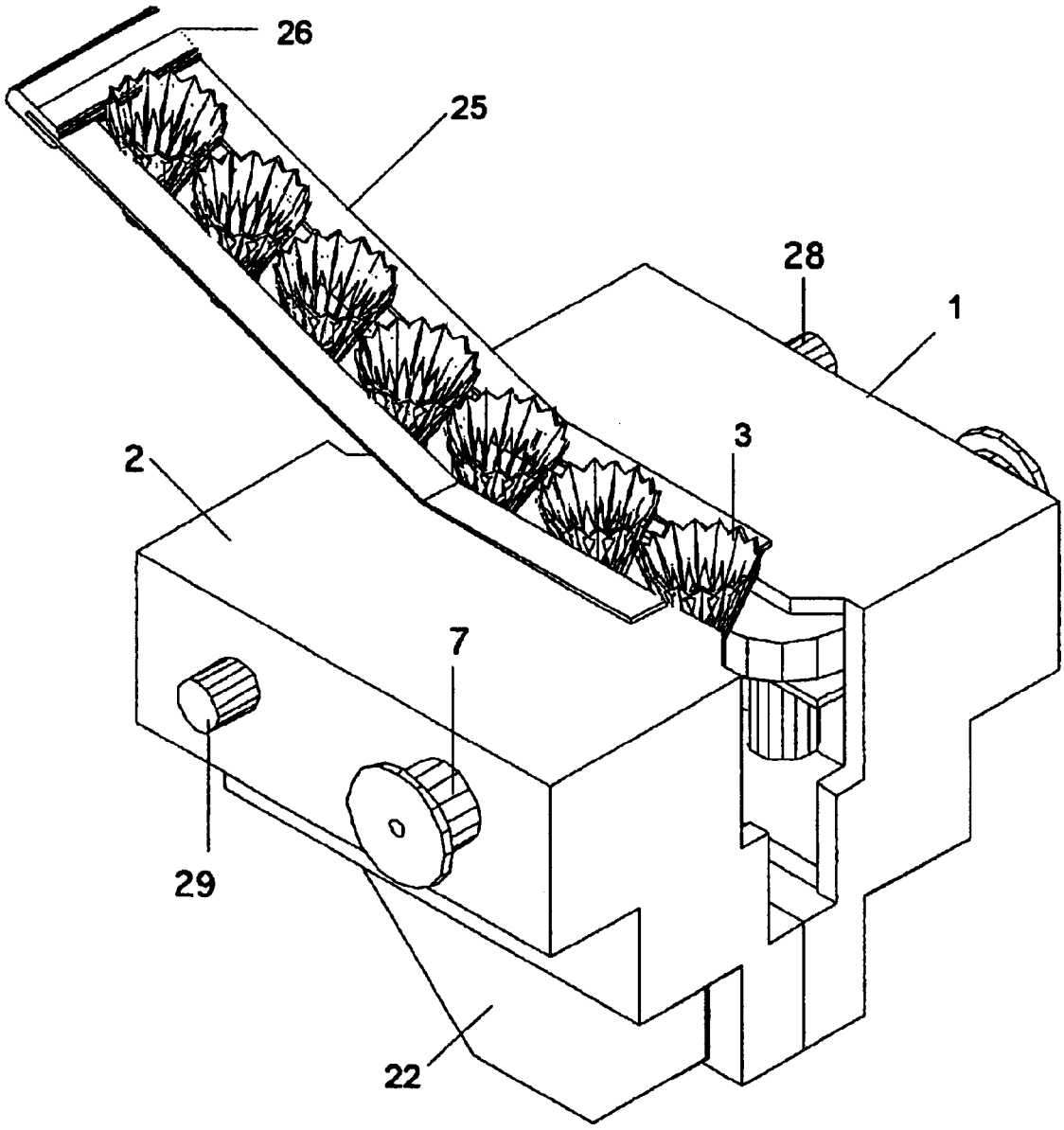
FIG. 1 is a perspective view of a shuttlecock throwing machine.

The shuttlecock launching machine of this invention includes a base member 1,2 preferably made in the form of a moulded plastic or a metal casting for mounting a shuttlecock dispenser 25, a loading mechanism and an ejecting wheel assembly as shown in FIG. 1.

Figure 2:
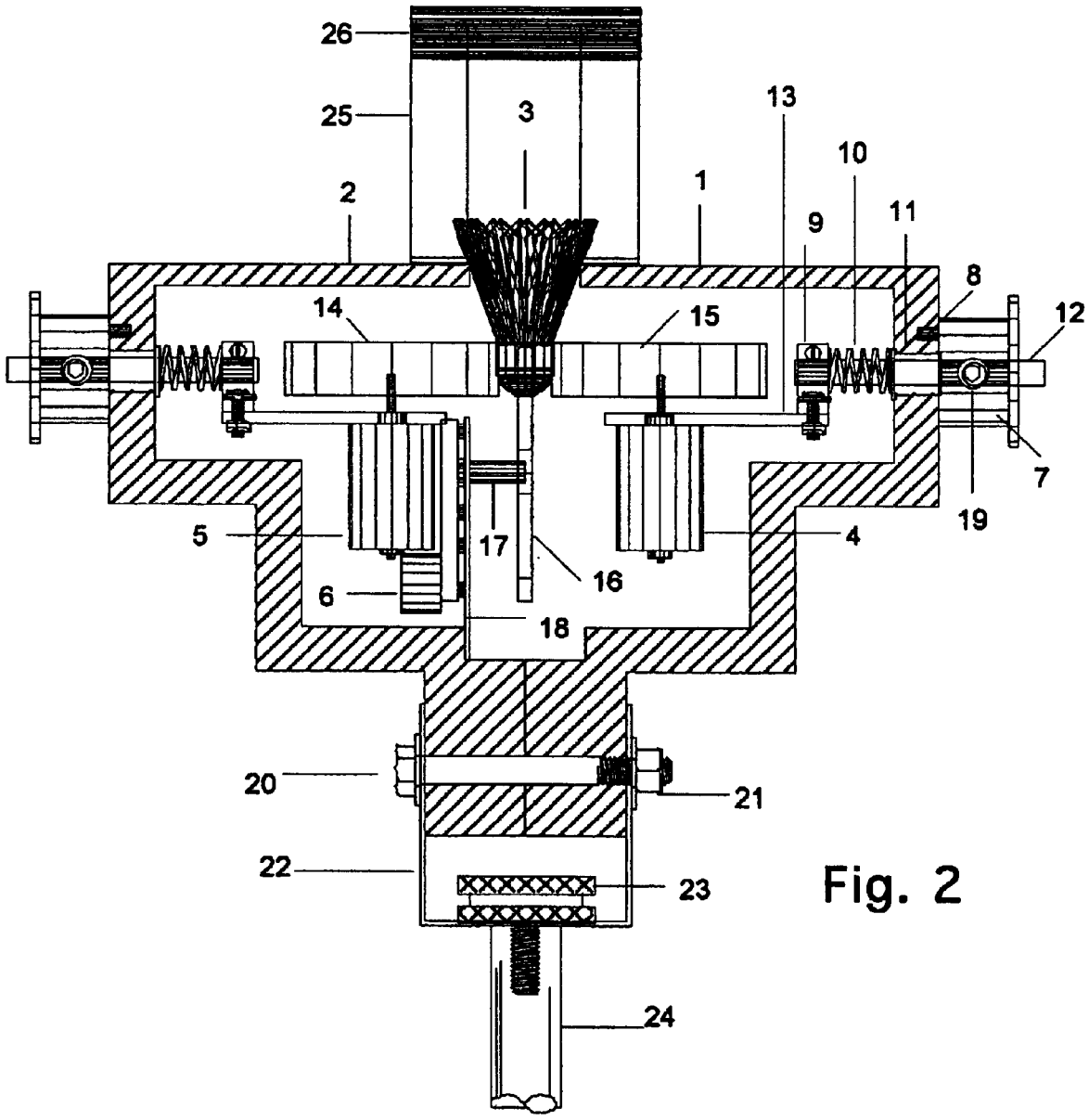
FIG. 2 is a front elevation view of the embodiment shown in FIG. 1.

In the annexed drawings FIG. 2, a pair of motor driven wheels 14,15 spaced over a distance slightly smaller than the diameter of the shuttlecock cap is mounted onto the base frame 1,2. Wheels 14,15 are mounted directly to two standard high speed DC motors 4,5. An electronic speed controller is provided to adjust the rotational speed of motors 4,5. Motor 4 is fastened to a motor housing 13 and a shaft support 9. The shaft support 9 is bolted to an axle 12. A compression spring 10 is inserted on to axle 12 which is then interposed into base frame 1 supported by impregnated bearing 11. An indexed knob 7 having a pin 8 is attached by means of set screw 19 to axle 12 from the outside of the base frame 1 for manual adjustment and setting of the wheel 14,15 gap as well as the rotational plane of wheel 15. An identical procedure is repeated to mount wheel 14 and motor 5 to base frame 2. Base frames 1,2 are therein combined to form an integral unit by any conventional mean of nuts 21,30 and bolts 20,27 combination. The compression springs 10 permit the ejecting wheels 14,15 to recoil laterally at various wheel planes.

Figure 4:
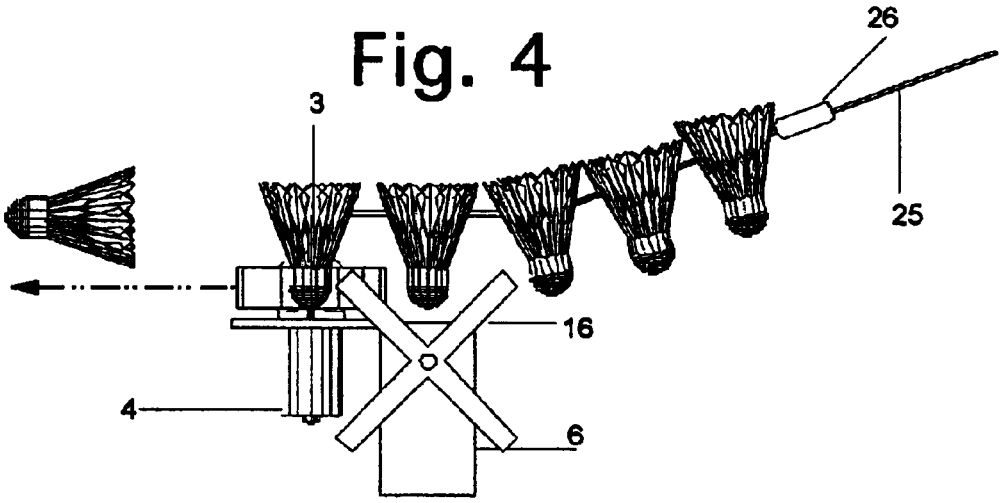
FIGS. 4, 5 and 6 are fragmentary views in side elevations, similar to FIG. 3, showing the wheel plane in various angles.
Figure 5:
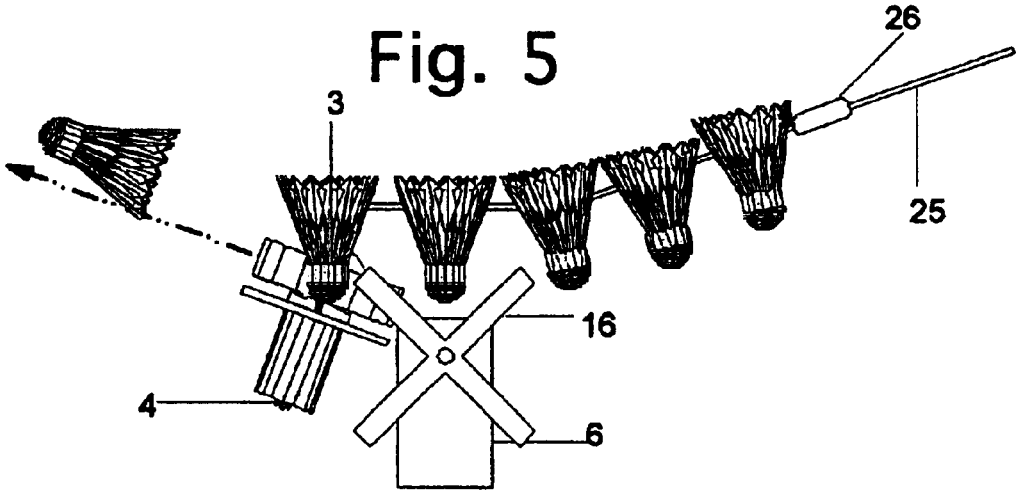
Figure 6:
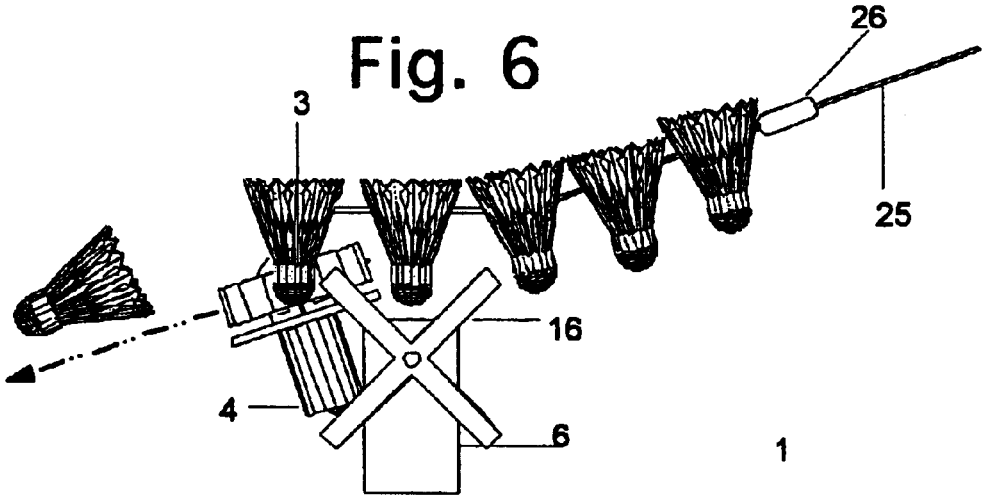

By merit of the articulated assembly of the ejecting wheels, as described hereinbefore, the rotational plane of the wheels is adjustable through a range of specified angles on the wheel horizontal axis through the rotation of axle 12 by means of the indexed shaft collar pin 8 affixed to the holes herein provided on the base frame. The adjustments of wheel plane, together with the adjustment of the rotational speed of the ejecting wheels provide a wide range of trajectories and linear velocity of the shuttlecock flight. For example, when the plane of the ejecting wheels is positioned in a horizontal plane as illustrated in FIG. 4, a substantially straight shuttle flight will be delivered from this machine when both wheels are rotated at the same speed. Consequently, with the rotation plane of both wheels tilted upward or downward, the shuttlecock will be ejected corresponding to the wheels plane as illustrated in FIGS. 4, 5 and 6.

Figure 3:
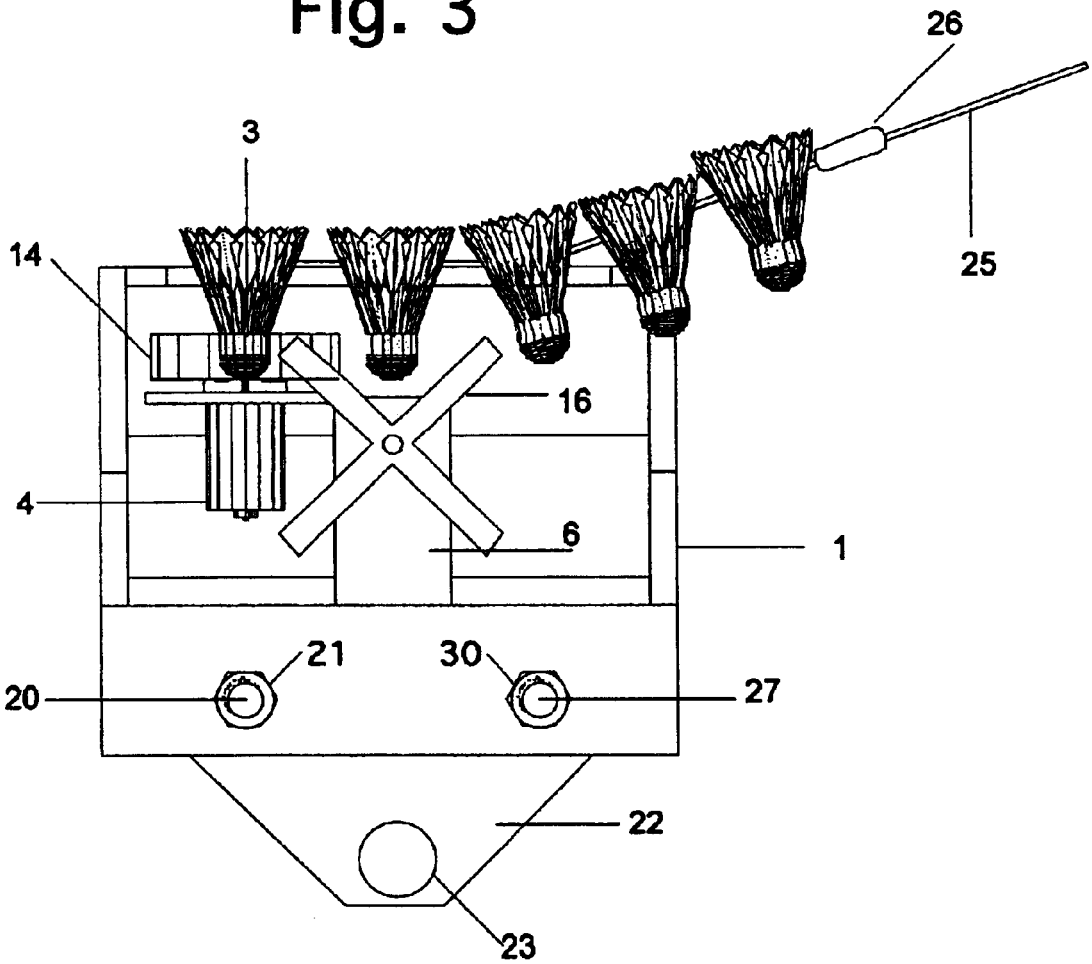
FIG. 3 illustrates the side elevation view of the embodiment shown in FIG. 1; with one base frame removed to reveal the feeding mechanism.

A detailed embodiment of the loading mechanism is shown in FIG. 3, consisting of a four-spoke gear 16 driven by a gearmotor 6 or the like is mounted onto the base frame 1 by means of a motor housing plate 18. A DC motor speed controller is also provided for gearmotor 6, allowing for a rotational speed adjustment of the four spoke gear. A time delay or remote switch is also provided to allow a player to get into a ready position on the opposite court. The four-spoke gear 16 is positioned between the ejecting wheels 14,15 and below the shuttlecock dispenser 25 as shown in FIG. 3. The tip of the four-spoke gear drives shuttlecock 3 into the direction of the gap between the pair of ejecting wheels 14,15.

The shuttlecock dispenser 25 consists of a pair of parallel or spiral bars or the like affixed on the top surfaces of base frame 1,2 between the channel forms by base frame 1 and 2. The dispenser 25 slopes into the entrance of the loading rotor 16 mounted on shaft 17 of a DC gearmotor 6 as shown in FIG. 3. Shuttlecocks are placed vertically with the noses end facing down however, subsequent shuttlecocks are led in queued as oppose to stacking on each other axially. A sliding polypropylene block 26 or the like may be added at the highest end of the shuttles to assist the shuttlecocks downward movement when needed.

An onboard AC to DC power converter and a rechargeable deep cycle battery is herein provided to supply power to the high speed DC motors 4,5 and the gearmotor 6. All of the motors are equipped with a solid state power control circuit operable to switch power on and off many times per second in pulses of variable duration to provide wide-range speed control. Switch 28 is designated for motor 4 and 5, whereas switch 29 will be designated to gearmotor 6. Thus, for example, the frequency of shuttlecock launchings may be from less than one-second intervals to several minutes between launches. Mounting frame 22 is provided for convenient connection between the integral base frame 1,2 to any conventional elevated stand 24 secured with knob 23.

Frictional material is preferably located on the circumference of each wheel 14,15 for engagement with the cylindrical section of the shuttlecock cap.

I claim:

1. A shuttlecock launcher, comprising:

a) a shuttlecock dispenser having a pair of bars spaced apart smaller than the maximum diameter of a shuttlecock, said dispenser capable of housing a plurality of shuttlecocks for dispensing in a queued manner;

b) a shuttlecock loading mechanism for retrieving shuttlecocks from said shuttlecock dispenser and feeding the shuttlecocks one at a time to a desired launching position and;

c) an ejecting wheel assembly comprising a pair of ejecting wheels for gripping and propelling a shuttlecock cap by friction at said launching position thereby launching the shuttlecocks fed by said loading mechanism, each said wheel defining a respective wheel plane, said ejecting wheels assembly including:

indexing means for selectively indexing the pitch of the wheel plane about a wheel horizontal axis; and recoiling means for permitting said ejecting wheels to recoil laterally at various wheels planes.

2. The shuttlecock launcher as claimed in claim 1, wherein said spaced bars are positioned horizontally.

3. The shuttlecock launcher as claimed in claim 1, wherein said bars are positioned at an incline.

4. The shuttlecock launcher as claimed in claim 1, wherein frictional material is located on the circumference of each wheel for engagement with the cylindrical section of a shuttlecock nose.

5. The shuttlecock launcher as claimed in claim 1, wherein said recoiling means comprises a pair of compression springs permitting the ejector wheels to act horizontally at various wheels planes.

6. The shuttlecock launcher as claimed in claim 1, wherein said indexing means selectively alters the pitch of the ejecting wheels and adjusts the gap between the ejector wheels, via an indexed knob.

7. The shuttlecock launcher as claimed in claim 1, wherein said ejecting wheel assembly comprises a motor including a motor speed controller whereby the linear velocity of the ejected shuttlecock is controlled by appropriate adjustment of the rotational speed of said motor.

8. The shuttlecock launcher as claimed in claim 1 wherein said loading mechanism comprises a four-spoke gear powered by a gearmotor having a speed controller for adjustment of its rotational speed to vary the frequency of shuttlecocks launch from less than one-second intervals to several minutes between launches.

9. The shuttlecock launcher of claim 1 wherein said shuttlecock launcher launches a natural feather shuttlecock for use in the game of badminton.

10. The shuttlecock launcher of claim 1 further including a remote controller for remote activation.

11. The shuttlecock launcher of claim 1 further including an onboard AC to DC power converter and a rechargeable deep cycle battery to supply power to said shuttlecock loading mechanism and said ejecting wheel assembly.

12. The shuttlecock launcher of claim 1 wherein said bars are substantially parallel.

13. The shuttlecock launcher of claim 1 wherein said shuttlecock launcher launches a synthetic feather shuttlecock for use in the game of badminton.

14. The shuttlecock launcher of claim 1 further including a microprocessor for controlling the sequence and/or speed of the gear motor.

* * * * *